United States Patent [19]

Meurer

[11] Patent Number: 4,457,353

[45] Date of Patent: Jul. 3, 1984

[54] STARTER APPARATUS FOR A CONTINUOUS CASTING PLANT, ESPECIALLY FOR CASTING STEEL STRANDS

[75] Inventor: Heinz Meurer, Willich, Fed. Rep. of Germany

[73] Assignee: SMS Schloemann-Siemag AG, Düsseldorf, Fed. Rep. of Germany

[21] Appl. No.: 434,913

[22] Filed: Oct. 18, 1982

[30] Foreign Application Priority Data

Nov. 4, 1981 [DE] Fed. Rep. of Germany ..... 3143639

[51] Int. Cl.[3] ..... B22D 11/08

[52] U.S. Cl. ..... 164/426; 164/446

[58] Field of Search ..... 164/425, 426, 445, 446, 164/483

[56] References Cited

U.S. PATENT DOCUMENTS

| | | | |
|---|---|---|---|
| 3,351,124 | 11/1967 | Hess | 164/426 |
| 3,800,849 | 4/1974 | Knell et al. | 164/425 |
| 3,817,316 | 6/1974 | Koch et al. | 164/426 |
| 4,079,775 | 3/1978 | Scheinecker | 164/426 |
| 4,109,700 | 8/1978 | Scheinecker | 164/426 |
| 4,114,679 | 9/1978 | Loibl et al. | 164/426 |

FOREIGN PATENT DOCUMENTS 2221187 10/1980 Fed. Rep. of Germany ..... 164/426

*Primary Examiner*—Kuang Y. Lin
*Assistant Examiner*—Richard K. Seidel
*Attorney, Agent, or Firm*—Werner W. Kleeman

[57] ABSTRACT

A flexible dummy or starting bar provided with a dummy bar head for closing the opening of a continuous casting mold is insertable into and again retractable from a guide device which is pivotable in a substantially vertical plane in order to allow for the intermediate storage of such dummy or starting bar. To obtain a starter apparatus possessing longer exchange intervals for the dummy bar heads caused by wear and changes in the sectional shape or format and for reducing the downtimes of the continuous casting plant the dummy bar is provided at each end with a dummy bar head. The guide device which is mounted at one end region at a carriage which can travel upon the casting platform is pivotable by means of its free end from a transport or conveying plane of a delivery or run-out roller table of the continuous casting plant up to a plane located above an upper edge of the continuous casting mold.

7 Claims, 2 Drawing Figures

STARTER APPARATUS FOR A CONTINUOUS CASTING PLANT, ESPECIALLY FOR CASTING STEEL STRANDS

BACKGROUND OF THE INVENTION

The present invention relates to a new and improved construction of starter or starting apparatus for a continuous casting plant or installation, especially for the casting of steel strands.

Generally speaking, the starter apparatus of the present development is of the type wherein a felxible dummy or starting bar provided with a dummy bar head for closing the opening of a continuous casting mold can be displaced by a drive into the arcuate or curved strand guiding arrangement or roller apron, and for the intermediate storage of the dummy bar such can be moved into a guide device which is pivotable in a substantially vertical plane.

During the continuous casting of steel strands the continuous casting mold is closed at its bottom end at the start of the casting operation by means of a dummy bar head which is arranged at a dummy or starting bar. This dummy bar head prevents the outflow of the liquid steel during the start of the casting operation. The steel solidifies at the dummy bar head which is provided with an undercut portion, so that the cast strand is securely connected with the dummy or starting bar. During the start of the continuous casting operation the dummy bar, which is transported by drive rolls through the strand guide arrangement or roller apron determines the withdrawal speed of the cast strand or casting. After the start of the casting operation the dummy bar head is released from the cast strand and the dummy bar is conveyed from the run-out roller table or bed to an intermediate storage.

According to a prior art continuous casting plant, as disclosed in U.S. Pat. No. 3,351,124, granted Nov. 7, 1967, there is pivotably mounted at the casting hall framework or girders a guide device serving as the intermediate storage for the dummy or starting bar. The free end of such guide device can be lowered by the action of a pressurised fluid medium cylinder arrangement up to the region of a transport or conveying plane of a run-out roller bed of the continuous casting plant. The dummy bar is pulled by a traction cable into the guide device for intermediately storing such dummy or starting bar. In order to start-up the continuous casting plant the dummy bar, following the outfeed of the cast strand upon the run-out or delivery roller bed, is lowered and conveyed by the driving unit or drive rolls through the roller apron until the dummy bar head closes the continuous casting mold. A great deal of time is needed between the pouring or teeming operations for inserting the dummy bar from the run-out roller bed through the entire strand guide arrangement or roller apron after the complete run-out of the cast strand.

It is already known to the art from U.S. Pat. No. 3,817,316, granted June 18, 1974 to introduce the dummy bar from above the casting platform through the mold opening into the strand guide arrangement or roller apron, in order to reduce the time losses resulting from the run-out of the end of the cast strand and the insertion of the dummy bar. Since this can be accomplished already during the run-out of the cast strand there is reduced, in this manner, the downtimes of the casting plant.

In German Pat. No. 2,221,187, granted Oct. 2, 1980, there is disclosed an apparatus for the insertion of the dummy bar from above through the mold opening into the strand guide arrangement. This apparatus comprises a carriage which can travel upon the casting platform and contains a dummy bar bed which can be pivoted into a vertical transfer position, and which is provided with a hook for the suspension of the dummy or starting bar as well as with a chain drive for the insertion of the dummy bar into the strand guide arrangement or roller apron. With this equipment the dummy bar is suspended at a crane hook and raised from the run-out roller table or bed to a location above the casting platform and transferred to the hook of the vertically disposed dummy bar bed. After the downward pivoting of the dummy bar bed it is possible, for instance, to exchange a dummy or starting bar head or to alter its format. Thereafter, the carriage is brought to the continuous casting mold and the dummy bar is lowered by means of the chain drive through the intermediary of an arcuate guide arrangement through the mold opening into the strand guide arrangement or roller apron. This starter apparatus is not advantageous for use with twin-pours, since the intermediate separation or partition wall of the mold hinders the insertion of the dummy bar from above.

With the known constructions of apparatus the accommodation of the dummy bar head to a new casting format or sectional shape can be accomplished within certain tolerances or limits by mounting or removing lateral adaptation or fitting elements. In the case of larger format changes, and equally when encountering wear of the dummy bar head, the latter must be exchanged with the aid of a crane. For such work there must be available during the standstill or downtimes operating personnel and a crane or the like.

SUMMARY OF THE INVENTION

Therefore, with the foregoing in mind it is a primary object of the present invention to provide a new and improved construction of starter apparatus for a continuous casting plant which is not associated with the aforementioned drawbacks and limitations of the prior art proposals.

Another and more specific object of the present invention is directed to a new and improved construction of starter apparatus affording longer exchange intervals for the dummy bar heads and which are caused by wear and changes in the format of the dummy bar heads, in order to reduce the downtimes of the continuous casting installation and to reduce the necessity for working with cranes or the like and performing manual operations.

A still further important object of the invention aims at providing an improved construction of starter apparatus of the character described which renders possible, in a brief amount of time, the transition between casting a slab and casting a number of smaller slabs in a continuous casting mold without the need for performing set-up work at the starter apparatus.

Yet a further important object of the present invention concerns an improved starter apparatus for initiating a continuous casting operation, wherein it is possible with a multi-strand casting installation to achieve a simpler and more rapid accommodation of the starter apparatus to a new casting format or sectional shape.

Now in order to implement these and still further objects of the invention, which will become more readily apparent as the description proceeds, the starter apparatus of the present development is manifested by the features that the dummy or starting bar is provided at each end with a dummy bar head. Furthermore, the dummy bar-guide or receiving device which is mounted at one end region at a mobile carriage or the like which can travel upon the casting platform, can be pivoted with its free end from the region of a transport or conveying plane of a run-out roller table or bed of the continuous casting installation up to the region of a plane located above an upper edge of the continuous casting mold.

In this way there is achieved the beneficial result that the transfer of the dummy or starting bar from the run-out or delivery roller table up to a location above the casting platform can be accomplished without the need for any crane and manual work solely by means of the pivotable guide or receiving device. When the casting format remains the same the dummy bar is only introduced from above through the continuous casting mold into the strand guide arrangement or roller apron, and both of the dummy bar heads alternately close the continuous casting mold.

Since the dummy bar heads can be used in this manner twice as long, it is possible to correspondingly prolong the exchange intervals, so that the availability of the continuous casting installation for performing the actual casting operations is enhanced.

With a claw-like construction of the dummy bar heads the claw members are arranged in opposite side directions.

According to a further feature of the invention, the dummy or starting bar can be provided with two dummy bar heads having different sectional shapes or formats. Consequently, there is rendered superfluous the changing or exchange of the dummy bar head during each change in the format or sectional shape of the cast strand. Hence, for both formats there is accomplished the insertion of the dummy bar from the run-out roller bed or table through the strand guide arrangement or roller apron. Only upon changing to the other casting format is the dummy bar inserted once from above through the opening of the continuous casting mold, whereafter in each case the other dummy bar head closes the opening of the continuous casting mold.

At least at one side or end of the dummy bar there can be provided a bifurcated or fork-like configured dummy bar head having a number of head portions for neighboring openings of a continuous casting mold having a subdivided hollow mold cavity or compartment. With such type of dummy or starting bar it is possible to cast both a wide slab strand and also two or more narrow slabs or bloom or ingot strands.

To facilitate the transfer of the dummy bar between the run-out roller table or bed and the pivotable guide or receiving device and the insertion of the dummy bar from above through the continuous casting mold, as the case may be, it is possible for the free end of the pivotable guide device to be branched in the pivot plane thereof into a respective arcuate-shaped deflection means or portion operatively correlated with the run-out roller table and the mold opening, respectively.

The pivotable guide or receiving device can have operatively associated therewith a suitable pivot drive means in the form of a cable winch arranged at the mobile carriage.

In the case of a multi-strand continuous casting installation working with a number of dummy or starting bars, it is possible according to a further feature of the invention, to mount for pivotable movement independent of one another a plurality of guide devices at the carriage, each of these guide devices serving for the guiding and storage of one of the dummy bars. In direct relation to the number of strands there is afforded a greater saving in the crane and manual work both with constant format and also with format changes.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2:
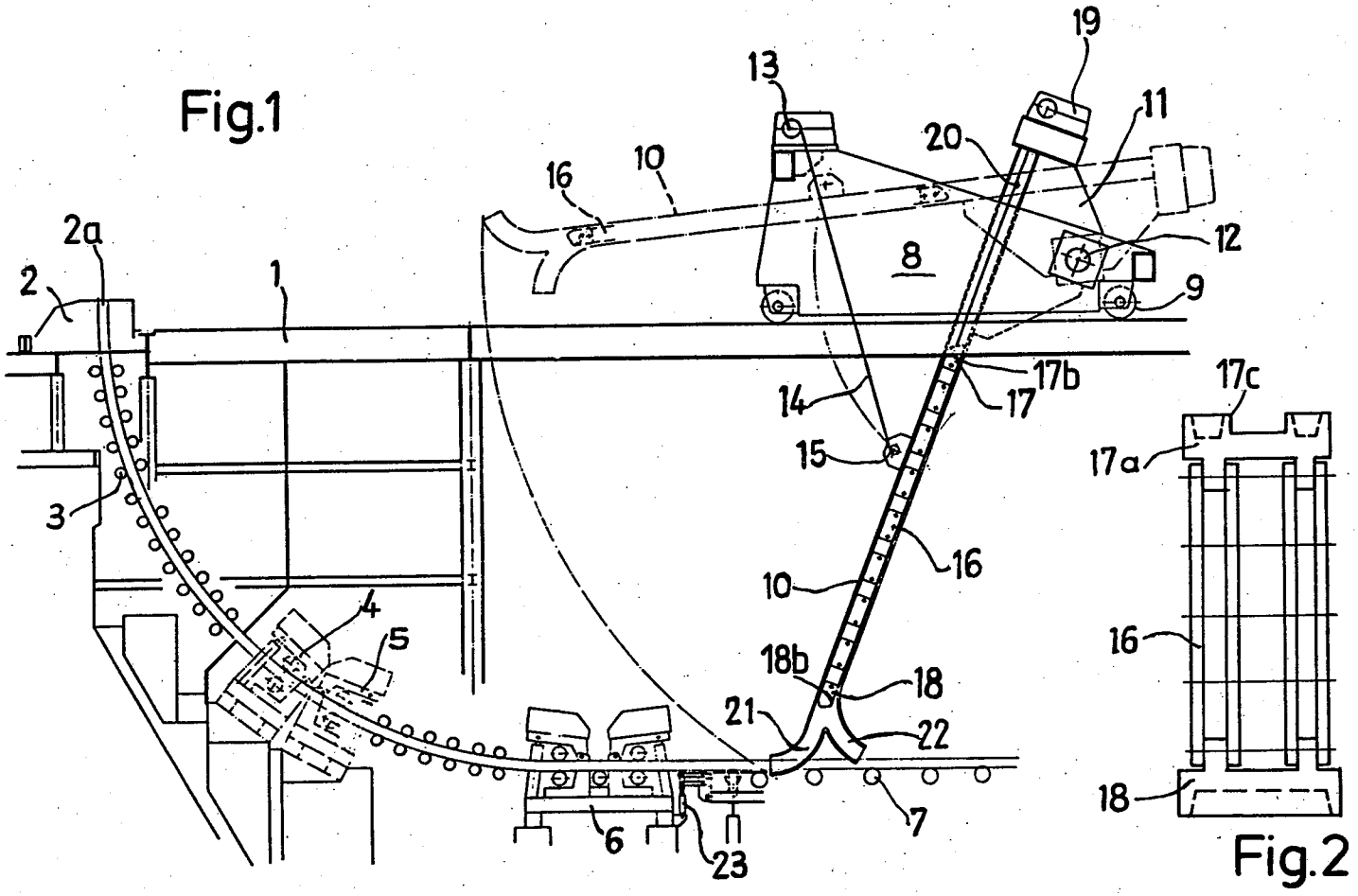
FIG. 1 is a schematic side view illustrating a starter or starting apparatus for a continuous casting installation or plant, especially for casting steel strands, and constructed according to the present invention.
FIG. 2 is an end view of a modified construction of dummy or starting bar which can be used in the starter apparatus of FIG. 1.

Describing now the drawings, it is to be understood that only enough of the construction of the continuous casting plant or installation for casting strands, especially steel strands, has been shown in the drawings as needed for those skilled in the art to readily understand the underlying principles and concepts of the present development while simplifying the illustration of the drawings. Turning attention now to FIG. 1, the continuous casting plant or installation depicted therein will be seen to comprise an open-ended continuous casting mold 2 having a throughpass or mold opening 2a and arranged upon a casting platform 1 or the like. A strand guide arrangement or roller apron 3 is arranged following or downstream of the continuous casting mold 2 and contains intermediately arranged sets of driving or drive rolls 4 and 5 and a withdrawal and straightening apparatus or machine 6 arranged essentially in horizontal direction. Following the withdrawal and straightening machine 6 is a delivery or run-out roller table or bed 7. In the context of the disclosure it is to be understood that the term "strand guide arrangement" is used in its broader sense, so that wherever appropriate such also encompasses strand supporting and guide arrangements which perform both a strand supporting and guide function.

Upon the casting platform 1 there can move back-and-forth upon wheels 9 or the like a carriage or dolly 8 or equivalent structure essentially within the vertical plane containing the strand guide arrangement 3. A dummy bar-guide device or guide means 10 is connected with a support bracket or element 11 which is mounted upon a pivot shaft or axle 12 at the carriage 8. At the front side of the carriage 8 there is arranged a motor-driven cable winch 13 or equivalent hoisting device, the cable 14 of which is secured by means of an eyelet 15 at the dummy bar-guide or receiving device 10.

This guide device 10 contains a not particularly illustrated but conventional roller track for supporting and storing a dummy or starting bar 16. At each end of this dummy bar 16 there is arranged a dummy or starting bar head 17 and 18, respectively. The guide device 10 is provided at its end region in the neighborhood of its pivot shaft 12 with a cable winch 19 or equivalent hoisting structure, the cable 20 or the like of which is selectively connectable with one of the dummy bar heads 17 or 18, respectively. The dummy bar heads 17 and 18 may possess a claw-like construction, wherein the claw members thereof, generally indicated by reference characters 17*b* and 18*b*, respectively, are arranged in opposite lateral or side directions.

The free end 10*a* of the guide device 10 is branched into two arcuate or curved portions 21 and 22 defining deflection means or elements, wherein the curved deflection portion 21 is operatively correlated with the run-out roller table or bed 7 and the curved deflection portion 22 is operatively correlated with the throughpass opening 2*a* of the continuous casting mold 2. At the region of the run-out roller table or bed 7 there is located a release or delatching device 23 for the dummy bar heads 17 and 18.

If the starter apparatus is used with a multi-strand casting installation working with a number of dummy or starting bars, then there can be provided a plurality of guide or receiving devices 10 at the carriage 8. Each of these guide devices 10 is mounted to be pivotable independent of one another and each services a related dummy or starting bar.

Having now had the benefit of the foregoing description the mode of operation of the exemplary embodiment of starter apparatus will be described.

For casting a sectional shape or format there are mounted at the ends of the dummy bar 16 dummy bar heads 17 and 18 having the same cross-sectional shape or configuration. For starting-up the continuous casting plant the guide device 10 is upwardly pivoted or rocked into the position illustrated in broken or phantom lines and the mobile carriage or dolly 8 is moved in the direction of the continuous casting mold 2 until the curved deflection portion 22 is aligned with the throughpass opening 2*a* of the continuous casting mold 2. Upon extension of the cable 20 the dummy bar 16, due to the action of its inherent weight, travels through the continuous casting mold 2 into the strand guide arrangement or roller apron 3. As soon as the dummy bar 16 has been seized by the sets of driving or drive rolls 4 and 5 the cable 20 can be released from the related dummy bar head 17 or 18, as the case may be.

The carriage 8 then is moved back and the guide device 10 lowered until the curved deflection portion 21 is aligned with the run-out roller table or bed 7 and is in a position where it is capable of receiving the dummy or starting bar 16. In order to draw the dummy bar 16 into the guide device 10 the cable 20 of the cable winch 19 is connected with the dummy bar head 17 or 18, as the case may be. Since the insertion of the dummy bar 16, with constant sectional shape or format of the cast strand, always is accomplished from above through the continuous casting mold 2, both of the dummy or starting bar heads 17 and 18 are only loaded each second time by the performed casting starting operation, so that their service life is prolonged.

In the case of a dummy or starting bar 16 containing two dummy bar heads 17 and 18 of different cross-sectional shapes or formats, the dummy bar 16 is again guided in each case out of the guide device 10 through the curved portion 21 onto the run-out roller table 7 in order to cast a predetermined format, and then such dummy bar 16 is conveyed by the strand guide arrangement 3 up to the continuous casting mold 2. Only for purposes of format change is the dummy bar 16 introduced once from above through the continuous casting mold 2, whereafter the other dummy bar head 17 or 18, as the case may be, closes the continuous casting mold 2 which is accommodated in its format or sectional shape.

The new and improved construction of starter apparatus of the present development renders possible also the transition from a wide slab strand to a number of narrow slab strands or bloom-like or ingot strands. Hence, as best seen by referring to FIG. 2, there is secured at one side of the dummy bar or starting bar 16 a bifurcated or fork-like configured dummy bar head 17*a*, the head portion 17 of which is dimensioned so that it can close the throughpass openings of a known mold subdivided by intermediate walls.

While there are shown and described present preferred embodiments of the invention, it is to be distinctly understood that the invention is not limited thereto, but may be otherwise variously embodied and practiced within the scope of the following claims.

Accordingly, What I claim is:

1. In starter apparatus for a continuous casting plant, especially for casting steel strands, containing a continuous casting mold having a mold opening and an upper edge, a casting platform at which there is arranged the continuous casting mold, a curved strand guide arrangement following said continuous casting mold for guiding a cast strand received from the continuous casting mold, and a run-out roller table following said curved strand guide arrangement for the outfeed of the cast strand in a strand conveying plane, the improvement which comprises:

a flexible dummy bar provided at each end with a dummy bar head for closing the opening of the continuous casting mold;

a pivotable guide device pivotable in a substantially vertical plane for the intermediate storage and guiding of the dummy bar;

drive means for moving the dummy bar through the curved strand guide arrangement for closing the opening of the continuous casting mold by means of one or the other of the dummy bar heads;

mobile carriage means movable upon the casting platform;

said guide device having a free end; and means for pivotably mounting said guide device upon said mobile carriage such that its free end can be pivoted from the conveying plane of the run-out roller table of the continuous casting plant up to a plane located above the upper edge of the continuous casting mold.

2. The starter apparatus as defined in claim 1, wherein:

each of said dummy bar heads has a claw member possessing a substantially claw-shaped configuration; and said claw members being arranged to extend in opposite side directions.

3. The starter apparatus as defined in claim 2, wherein:

said two dummy bar heads of said dummy bar possess different sectional shapes.

4. The starter apparatus as defined in claim 1, wherein:

at least one of the dummy bar heads at one side of the dummy bar possesses a substantially fork-shaped configuration for closing neighboring mold openings of a continuous casting mold having a subdivided hollow mold compartment.

5. The starter apparatus as defined in claim 1, wherein:

said free end of the pivotable guide device is branched at a pivot plane thereof into two curved deflection portions; and one of said curved deflection portions being operatively correlated with the run-out roller table and the other curved deflection portion being operatively correlated with the opening of the continuous casting mold.

6. The starter apparatus as defined in claim 1, wherein:

said pivotably mounting means comprises cable winch means provided at the carriage and operatively connected with said pivotable guide device.

7. The starter apparatus as defined in claim 1, especially for use with a multi-strand continuous casting installation working with a number of dummy bars, wherein:

a plurality of said guide devices are arranged at said carriage; and each of said guide devices being pivotably mounted independently of one another at said carriage and servicing a related one of the dummy bars.

* * * * *